United States Patent [19]

Hudspeth et al.

[11] 4,427,953

[45] Jan. 24, 1984

[54] MICROWAVE DIPLEXER

[75] Inventors: Thomas Hudspeth, Malibu; Harmon H. Keeling, Kernville, both of Calif.

[73] Assignee: Hughes Aircraft Company, El Segundo, Calif.

[21] Appl. No.: 321,359

[22] Filed: Nov. 16, 1981

[51] Int. Cl.[3] ..... H01P 1/213

[52] U.S. Cl. ..... 333/134; 333/206; 370/37; 455/80

[58] Field of Search ..... 333/126, 129, 134, 135; 455/80–82; 370/37, 38

[56] References Cited

U.S. PATENT DOCUMENTS 2,984,798 5/1961 Bryan ..... 333/134

3,978,434 8/1976 Morz et al. ..... 333/135

*Primary Examiner*—Paul L. Gensler

*Attorney, Agent, or Firm*—C. L. Anderson; W. J. Benman, Jr.; A. W. Karambelas

[57] ABSTRACT

Apparatus for processing microwave signals at two predetermined frequencies. Signals at a first predetermined frequency are received or transmitted at one end (input port) of a microwave transmission line whose other end is utilized as a common output port for transmitting and receiving signals at both predetermined frequencies. A band rejection portion is provided which comprises first and second rejection resonators orthogonally disposed along the transmission line at two predetermined positions. A bandpass portion, comprised of a plurality of collinearly aligned bandpass resonators, is disposed at a third predetermined position along the transmission line. Signals at a second predetermined frequency are transmitted or received at a second input port which is part of the bandpass portion. All resonators are capacitively coupled together and to the transmission line. Signals at both predetermined frequencies may be applied to the first and second input ports and are combined in the transmission line by the filtering action of the resonators. Conversely, signals having both predetermined frequencies may be applied to the output port and separated in the transmission line such that signals at the first predetermined frequency are provided at the first input port and signals at the second predetermined frequency are provided at the second input port. Also, signals at one frequency may be transmitted by way of the diplexer while signals at the second frequency are received thereby, or vice-versa.

9 Claims, 7 Drawing Figures

MICROWAVE DIPLEXER

BACKGROUND OF THE INVENTION

The present invention relates generally to microwave diplexers, and more particularly to microwave diplexers employing complementary filtering techniques.

Diplexers are commonly known in the communications art, and are generally employed where several distinct frequencies are transmitted or received over the same communications link. For example, satellite communications systems employ microwave communication systems which commonly use diplexers to control the movement of separately distinct transmit and receive frequencies through the communication system. A diplexer is generally required to connect circuits which exclusively operate at one of the two frequencies to circuits which may utilize both frequencies.

In order to accomplish the diplexing function, prior diplexing schemes have utilized a waveguide cavity transmission filter tuned to one frequency coupled to a waveguide tuned to the second frequency but having a frequency cut off at the first frequency. Both the transmission filter and the waveguide are tapped into a second waveguide which is suitable for transmitting both frequencies.

Another prior art diplexer is disclosed in a publication entitled "Printed-Circuit Complementary Filters for Narrow Bandwidth Multiplexers", by Wenzel, in IEEE Transactions on Microwave Theory and Techniques, March 1968, pages 147 to 157. This publication generally discusses design techniques and interconnection equivalent circuits for constructing printed circuit narrowband complementary filters. The disclosed techniques describe contiguous band multiplexers using a single printed circuit board with no series or shorted stubs. Equivalent circuit transformations are discussed for design of a two-section stripline complementary filter pair.

SUMMARY OF THE INVENTION

The present invention provides for a microwave diplexer which is utilized at first and second predetermined frequencies. The diplexer comprises a microwave transmission line, which may have a square cross-section although numerous other cross-sectional shapes may be employed. A square or rectangular cross-section is commonly employed in microwave transmission devices in order to easily accomplish power dividing and coupling as required in the circuitry. One end of the transmission line is utilized as a first input port for transmitting or receiving signals at the first predetermined frequency. The other end of the transmission line is used as an output port for transmitting and receiving signals at both the first and second predetermined frequencies.

A band rejection portion of the diplexer comprises a first rejection resonator that is disposed at a first predetermined position along the transmission line adjacent to the first input port. A second rejection resonator is disposed at a second predetermined position along the transmission line and is oriented in a direction orthogonal to the first rejection resonator. The orthogonal orientation reduces coupling between the resonators. Both rejection resonators are capacitively coupled to the transmission line. Also the first and second rejection resonators are disposed a distance of one-quarter wavelength of the second predetermined frequency away from one another in order to form a band rejection filter.

A bandpass portion of the diplexer is disposed at a third predetermined position along the transmission line. The bandpass portion is located between the second rejection resonator and the output port, and in a direction opposite to that of the first rejection resonator. The bandpass portion is disposed a distance of one-quarter wavelength of the second predetermined frequency away from the second rejection resonator. The bandpass portion includes a second input port for receiving or transmitting signals at the second predetermined frequency. The bandpass portion also comprises first and second bandpass resonators which are collinearly aligned. The first bandpass resonator is capacitively coupled to both the transmission line and the second bandpass resonator. The second bandpass resonator is capacitively coupled to the second input port, which may comprise a commonly used 50 ohm microwave transmission line.

In operation, the diplexer can simultaneously transmit and receive signals at both predetermined frequencies. For example, the diplexer may be used to transmit and receive microwave signals at 4 gigahertz (GHz) and 6 GHz. The 4 GHz signals may be employed for transmission, while the 6 GHz signals are employed for reception. Signals at 4 GHZ are applied to the input port adjacent to the first rejection resonator and transmitted along the waveguide and out the output port. Signals are received at the output port at 6 GHz and are transmitted along the waveguide. The band rejection portion of the diplexer looks like an open circuit to the 6 GHz signal while the bandpass portion is tuned to pass the 6 GHZ signals. Accordingly, the 6 GHZ signals traverse through the bandpass portion and exit through the second input port. The diplexer may also be used in a converse manner wherein transmit signals at 6 GHZ are applied to the second input port and transmitted by way of the outport port, while the 4 GHZ signals are received at the output port and transmitted by way of the first input port.

An important, but not so obvious, feature of the diplexer is the use of orthogonally oriented band rejection resonators. The orthogonal orientation substantially reduces the coupling between the resonators. Hence, the resonators work independently of each other. The use of orthogonally disposed rejection resonators provides for a diplexer design which is quite efficient.

Both the band rejection resonators and the bandpass resonators are tuned to the higher predetermined frequency (6 GHz). This minimizes power loss at the lower predetermined frequency (4 GHz). In microwave communication systems, such as satellite microwave repeater or transponder, for example, the transmission power is most costly, hence systems are generally tuned to provide for minimum power loss at the transmit frequency (4 GHz in the example above).

The diplexer of the present invention is also substantially planar in design, except for the second rejection resonator. This type of design integrates well into current state-of-the-art microwave transmission line circuits.

The diplexer is not limited to only two specific frequencies. By selecting the 6 GHz frequency as the receive frequency, for example, the transmit frequency may be any lower or higher frequency which is outside the bandwidth of the 6 GHz bandpass filter portion of the diplexer. The output port is matched from DC to above the 6 GHz predetermined frequency. This is a characteristic of a complementary filter design, on which the present invention is based.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
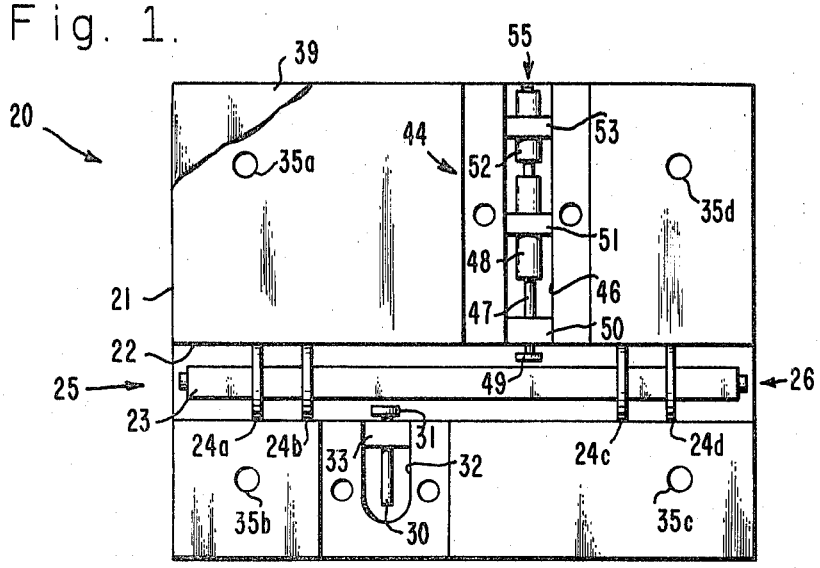
FIG. 1 is a top view of a diplexer in accordance with the present invention.

Referring to FIG. 1, a top view of a microwave diplexer 20 in accordance with the present invention is shown. The diplexer 20 is comprised of a support structure 21, which may be made of metal, or the like. A first channel 22 is cut in the surface of the support structure 21 along the length thereof. A microwave transmission line 23 is disposed in the first channel 22. The transmission line 23 is supported and isolated from the support structure 21 by means of a plurality of insulating spacers 24*a–d*. The insulating spacers 24 may be made of an insulating material such as polystyrene or Teflon, or the like.

It is to be understood that the transmission line 23 is the center conductor of the microwave waveguide with the support structure 21 providing the ground plane. The airspace between the transmission line 23 and the support structure 21 is the dielectric medium. This construction is analagous to a conventional coaxial cable. For purposes of this disclosure, however, the center conductor will be called the transmission line 23.

The transmission line 23 has a square cross-section in this particular embodiment, although numerous other cross-sectional shapes may be employed in other applications. The transmission line 23 may be a commonly used 50 ohm microwave transmission line known to those skilled in the art. One end of the transmission line 23 is utilized as a first input port 25 which is designated to receive or transmit signals at a first predetermined frequency. The other end of the transmission line 23 is utilized as an output port 26 which is suitable for transmitting and receiving signals at both first and second predetermined frequencies.

The diplexer 20 is comprised of a band rejection portion which includes a first rejection resonator 30 disposed in the first support structure 21. The first rejection resonator 30 is located in a second channel 32 cut in the support structure 21 which is transverse to the first channel 22. The first rejection resonator 30 is insulated from the first support structure 21 by means of an insulator 33. The first rejection resonator 30 is disposed at a first predetermined position along the transmission line 23, adjacent to the first input port 25. The insulator 33 is located at a position along the rejection resonator 30 where a voltage null exists, in order to minimize its effect on the resonant frequency of the resonator 30. The resonator 30 is capacitively coupled to the transmission line 23 at an end 31 which is proximal thereto.

Figure 1A:
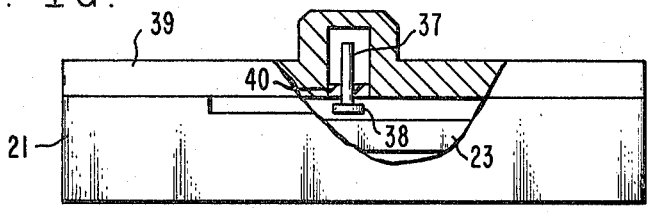
FIG. 1*a* is a side view of the diplexer of FIG. 1.

A second rejection resonator 37, which is most clearly shown in FIG. 1*a*, is disposed in a cover plate 39 which is secured to the support structure 21 in a conventional manner. For example, threaded holes 35*a–d* (FIG. 1) are provided to secure the cover plate 39 to the support structure 21. The second rejection resonator 37 is suitably insulated in the cover plate 39 by means of an insulator 40, such as a polystyrene or Teflon insulator, or the like. The second rejection resonator 37 is also capacitively coupled to the transmission line 23 at an end 38 which is proximal thereto. The second rejection resonator 37 is positioned at a point along the transmission line 23 which is a predetermined distance away from the first rejection resonator 30. This predetermined distance is generally equal to one-quarter wavelength of the second predetermined frequency applied to the diplexer 20. This separation is necessary in order to form the band rejection portion of the diplexer.

The second rejection resonator 37 is also disposed orthogonal to the first rejection resonator 30 in order to reduce direct coupling between the rejection resonators 30, 37. Both resonators 30, 37 work independently of one another. The orthogonally oriented resonators allow for a highly efficient diplexer design.

Referring again to FIG. 1, the diplexer 20 also comprises a bandpass portion 44 which is disposed along a third channel 46 cut in the support structure 21. The bandpass portion 44 is generally disposed in a direction opposite to that of the first rejection resonator 30, although this is not absolutely necessary. The bandpass portion 44 includes first and second bandpass resonators 47, 48 which are collinearly aligned in this specific embodiment.

The first bandpass resonator 47 is supported in the third channel 46 by means of an insulator 50, such as a polystyrene insulator, or the like. The insulator 50 is disposed at the voltage null of the resonator 47. The first bandpass resonator 47 is capacitively coupled to the transmission line 23 at an end 49 which is proximal thereto. The second bandpass resonator 48 is a tube arrangement which is supported in the channel 46 by means of an insulator 51, such as polystyrene, or the like. The insulator 51 is located at a position where a voltage null occurs in order to minimize the effect on the resonant frequency of the resonator 48. A portion of the first bandpass resonator 47 is inserted into the tube portion of the second bandpass resonator 48 without touching it. There is capacitive coupling between the bandpass resonators 47, 48, and the amount of coupling may be adjusted by the relative positions of the two resonators 47, 48.

A microwave transmission line 52 which is supported in the third channel 46 by an insulator 53 is utilized as a second input port 55 to the diplexer 20. The transmission line 52 is machined to have one end extend into the tube portion of the second resonator 48. There is capacitive coupling between the transmission line 52 and resonator 48. The transmission line may be a 50 ohm transmission line utilized for impedance matching purposes.

The bandpass portion 44 is disposed along the transmission line 23 at a point which is between the second rejection resonator 37 and the output port 26. The bandpass portion 44 is disposed a second predetermined distance from the second rejection resonator 37. This distance is also generally equal to one-quarter of wavelength of the second predetermined frequency applied to the diplexer 20.

The band rejection resonators 30, 37 and the bandpass resonators 47, 48 are designed to be forshortened half-wave resonators (between $\frac{1}{4}$ and $\frac{1}{2}$, due to the capacitive coupling). The capactitive couplings between resonators 47, 48 and between resonators 30, 37, 47, 48 and the transmission lines 23, 52 are adjusted by movement of the various components relative to one another.

The first band rejection resonator 30 is designed as a series resonant circuit between the transmission line 23 and the surrounding support structure. It shorts the transmission line 23 at the frequency where the reactance is zero. Therefore, there is a large reflection coefficient at the resonant frequency of the rejection resonator 30. The second rejection resonator 37 is also designed as a series resonant circuit. The first rejection resonator 30 acts like a parallel resonant circuit in series with the transmission line 23 at the point of the second rejection resonator 37. The second rejection resonator 37 also shorts the transmission line 23 at the frequency where the reactance is zero. Thus, a large reflection coefficient is provided by the second rejection resonator 37.

In operation, the diplexer 20 of FIG. 1 is utilized to couple signals at two predetermined frequencies from the transmission line 23 to portions of a microwave system which may separately process the two signals. For example, the two signals may be at frequencies of 4 and 6 gigahertz (GHz), with each signal having a 500 megahertz bandwidth. In a typical microwave communication system, the 4 gigahertz signal is used for transmission while the 6 gigahertz signal is used for reception. A typical communication system is one used in a spacecraft which transmits signals between an earth station and the satellite which orbits the earth.

The 4 gigahertz signal, which may be provided by a microwave transmitter, is applied to the first input port 25. The 4 gigahertz signal traverses the length of the transmission line 23 unattenuated and exits the diplexer through the output port 26. A 6 gigahertz signal which is received at a feedhorn, or antenna, is applied to the output port 26 and traverses along the transmission line 23.

Alternatively, the 4 and 6 gigahertz signals may be combined or separated in the diplexer 20 due to the filtering action thereof. Both signals may be applied to the common output port 26 and separately transmitted by the first and second input ports 25, 55, or vice-versa.

The band rejection resonators 30, 37 create an open circuit for the 6 gigahertz signal while the bandpass portion 44 creates an electrical path for the signal. Hence, the 6 gigahertz signal traverses through the bandpass portion 44 and out of the diplexer through the second input port 55. The diplexer 20 acts as a complementary filter which passes signals through the first input port 25 to those signals outside the 6 gigahertz bandwidth.

Typically, in microwave satellites, or the like, the transmission power is most precious and costly. Therefore, both the band rejection resonators 30, 37 and the bandpass resonators 47, 48 are tuned to the 6 gigahertz receive frequency. This minimizes the power loss at the 4 gigahertz transmit frequency.

The diplexer 20 has been described as transmitting 4 gigahertz signals and receiving 6 gigahertz signals. It is to be understood that the diplexer may just as easily receive the 4 gigahertz signals and transmit the 6 gigahertz signals. The paths along the transmission line 23 and bandpass portion 44 are bidirectional.

Figure 2:
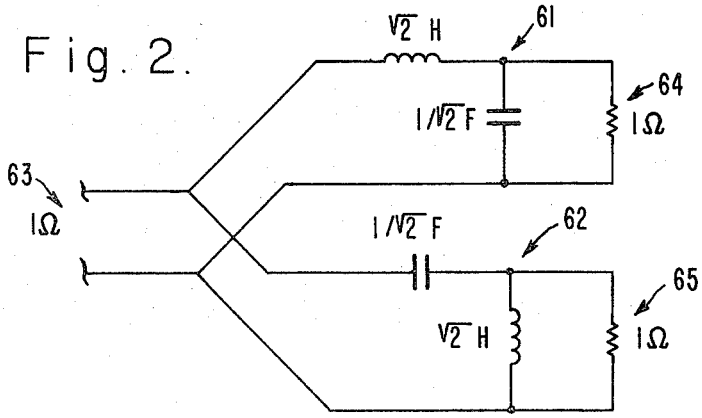
FIG. 2 shows the electrical network on which the present invention is based.

The design of the diplexer 20 is based upon the electronic filter network shown in FIG. 2. The filter network shown is analogous to the diplexer 20 of FIG. 1 and there is a direct transformation therebetween. The filter network is comprised of a two-resonator high-pass section 61 and complementary low-pass section 62. The combination has a common port 63 with a constant input resistance over all frequencies when the input ports 64, 65 are terminated.

This design is that of a classical complementary filter network. The common port 63, which corresponds to the output port 26, is zero frequency centered with a ± one radian per second cutoff frequency. The inductor of the high pass section 61 corresponds to a series resonant circuit, while the capacitor thereof corresponds to a parallel resonant circuit. Similarly, the same correspondences are present with the capacitor and inductor of the low pass portion 62. This type of transformation is well-known to those skilled in the art of filter design.

Figure 3:
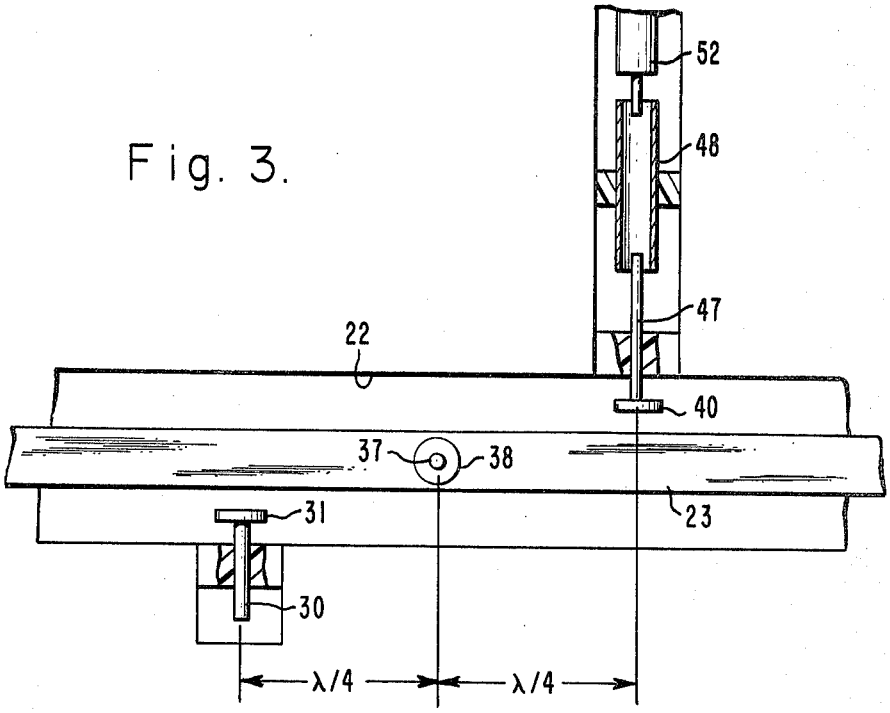
FIG. 3 is a diagram showing the layout of the diplexer of FIG. 1.

Referring to FIG. 3 there is shown a top view illustrating the diplexer 20 of FIG. 1. FIG. 3 shows the relative positions and spacing of the various components described with reference to FIGS. 1 and 1*a*.

Figure 4:
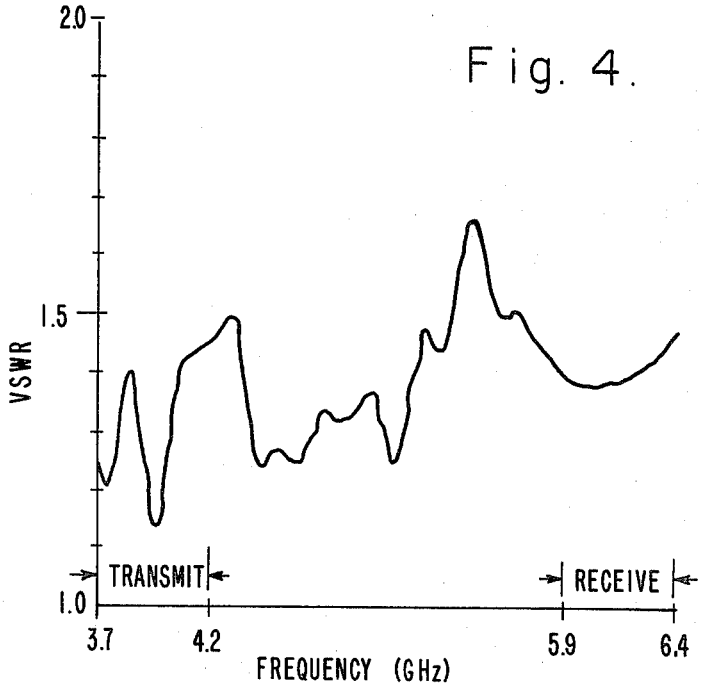
FIGS. 4–6 show test data run on the diplexer of FIG. 1.
Figure 5:
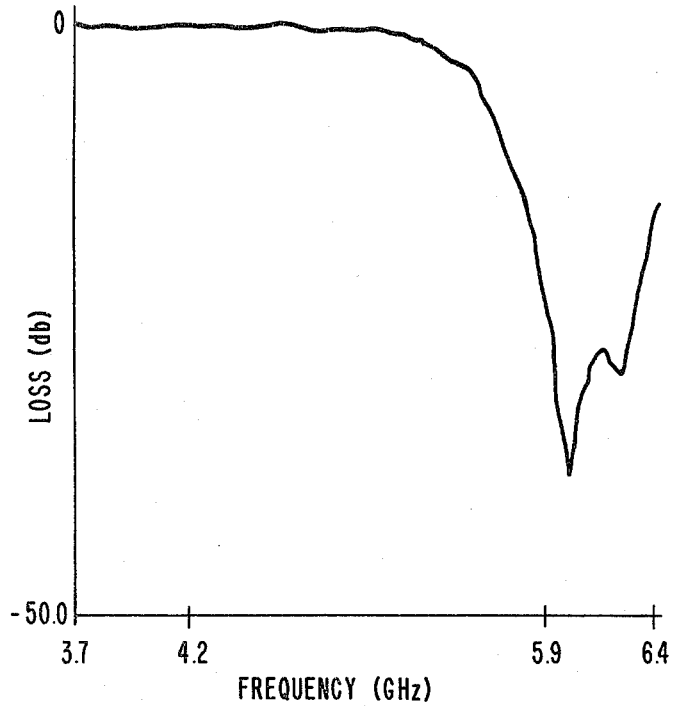
Figure 6:
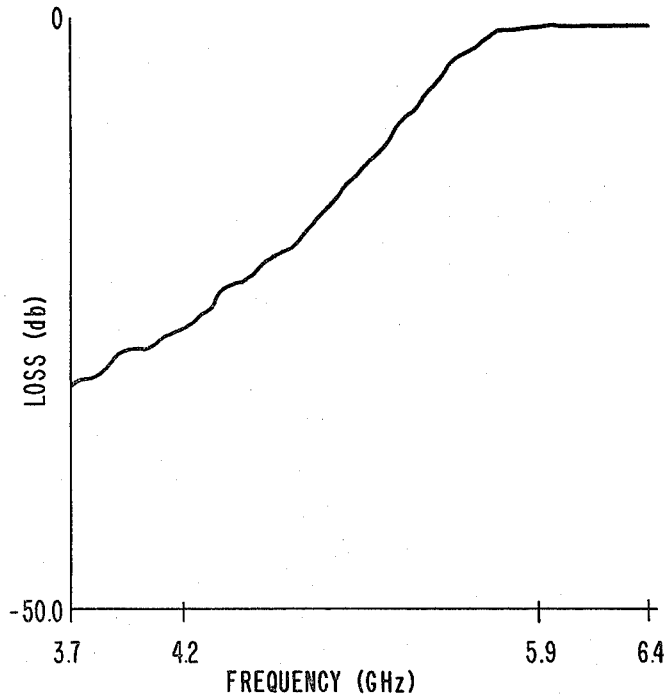

Referring to FIGS. 4 through 6, test data is shown for the diplexer 20 of FIG. 1. FIG. 4 shows a graph of voltage standing wave ratio (VSWR) versus frequency for the diplexer 20. the VSWR measurement is analogous to measuring the magnitude of the reflection coefficient. FIG. 5 shows a graph of loss in decibels versus frequency for the band rejection portion. FIG. 6 shows a graph of loss in decibels versus frequency for the bandpass portion.

Thus, there has been disclosed a new and improved microwave diplexer suitable for use in communication systems, such as satellite communication systems, or the like. The diplexer is a very compact and efficient design which is suitable for situations where space is limited.

It is to be understood that the above-described embodiment is merely illustrative of one of the many specific embodiments which represent applications of the principles of the present invention. Clearly, numerous and varied other arrangements may readily be devised by those skilled in the art without departing the spirit and scope of the invention.

What is claimed is:

1. A microwave diplexer comprising:

a microwave transmission line;

a band rejection portion comprising a first rejection resonator disposed at a first predetermined position along said transmission line, and a second rejection resonator disposed at a second predetermined position along said transmission line, said second rejection resonator being disposed orthogonal to said first rejection resonator; and a bandpass portion disposed at a third predetermined position along said transmission line, said bandpass portion including first and second capacitively coupled bandpass resonators, said first bandpass resonator being capacitively coupled to said transmission line.

2. The diplexer of claim 1 wherein said bandpass portion is disposed in a direction opposite to said first rejection resonator.

3. The diplexer of claims 1 or 2 wherein said first and second rejection resonators are capacitively coupled to said transmission line.

4. A microwave diplexer for use at first and second predetermined frequencies, said diplexer comprising:

a microwave transmission line having one end utilized as a first input port for receiving or transmitting signals at said first predetermined frequency, and having the other end utilized as an output port for transmitting and receiving signals at said first and second predetermined frequencies;

a band rejection portion comprising a first rejection resonator disposed at a first predetermined position along said transmission line adjacent to said first input port, and a second rejection resonator disposed at a second predetermined position along said transmission line distal from said first input port, said second rejection resonator being disposed orthogonal to said first rejection resonator; and a bandpass portion disposed at a third predetermined position along said transmission line between said second rejection resonator and said output port, said bandpass portion having a second input port for transmitting or receiving signals at said second predetermined frequency, said bandpass portion including first and second capacitively coupled resonators, said first bandpass resonator being capacitively coupled to said transmission line, said second bandpass resonator being capacitively coupled to said second input port.

5. The diplexer of claim 4 wherein said bandpass portion is disposed in a direction opposite to said first rejection resonator.

6. The diplexer of claim 4 or 5 wherein said first and second rejection resonators are capacitively coupled to said transmission line.

7. The diplexer of claim 4 or 5 wherein said said transmission line is a square transmission line.

8. A microwave diplexer for use at first and second predetermined frequencies, said diplexer comprising:

a microwave transmission line having a first port at one end and a second port at the opposite end, said first port being adapted for transmitting at said first predetermined frequency, said second port being adapted for transmitting at said first predetermined frequency and at said second predetermined frequency;

a band rejection portion for rejecting at said second predetermined frequency, said band rejection portion being located adjacent said first port, said band rejection portion including adjacent rejection resonators in orthogonal relation to each other, said resonators being spaced from one another along said transmission line; and a bandpass portion extending from adjacent said transmission line between said band rejection portion and said second port, said bandpass portion including a third port for transmitting at said second predetermined frequency so that energy received at said second predetermined frequency at said second port is transmitted to said third port and not to said second port, and so that energy received at said first predetermined frequency at said first port is transmitted to said second port and not to said third port.

9. The diplexer of claim 8 further characterized in that said resonators are spaced one-fourth wavelength of said second predetermined frequency apart along said transmission line.

* * * * *

REEXAMINATION CERTIFICATE (831st)

United States Patent [19] [11] B1 4,427,953

Hudspeth et al. [45] Certificate Issued Mar. 29, 1988

[54] MICROWAVE DIPLEXER

[75] Inventors: Thomas Hudspeth, Malibu; Harmon H. Keeling, Kernville, both of Calif.

[73] Assignee: Hughes Aircraft Company, El Segundo, Calif.

Reexamination Request:
No. 90/001,256, Jun. 9, 1987

Reexamination Certificate for:

| | |
|---|---|
| Patent No.: | **4,427,953** |
| Issued: | **Jan. 24, 1984** |
| Appl. No.: | **321,359** |
| Filed: | **Nov. 16, 1981** |

51] Int. Cl.[4] ..... H01P 1/213
52] U.S. Cl. ..... 333/134; 333/206; 370/37; 455/80
58] Field of Search ..... 333/208, 209, 212

56] References Cited

U.S. PATENT DOCUMENTS

| | | | |
|---|---|---|---|
| 2,954,536 | 9/1960 | Müller | 333/212 X |
| 3,428,918 | 2/1969 | Matthaei . | |
| 3,577,104 | 5/1971 | Levy | 333/212 |

*Primary Examiner*—Paul L. Gensler

[57] ABSTRACT

Apparatus for processing microwave signals at two predetermined frequencies. Signals at a first predetermined frequency are received or transmitted at one end (input port) of a microwave transmission line whose other end is utilized as a common output port for transmitting and receiving signals at both predetermined frequencies. A band rejection portion is provided which comprises first and second rejection resonators orthogonally disposed along the transmission line at two predetermined positions. A bandpass portion, comprised of a plurality of collinearly aligned bandpass resonators, is disposed at a third predetermined position along the transmission line. Signals at a second predetermined frequency are transmitted or received at a second input port which is part of the bandpass portion. All resonators are capacitively coupled together and to the transmission line. Signals at both predetermined frequencies may be applied to the first and second input ports and are combined in the transmission line by the filtering action of the resonators. Conversely, signals having both predetermined frequencies may be applied to the output port and separated in the transmission line such that signals at the first predetermined frequency are provided at the first input port and signals at the second predetermined frequency are provided at the second input port. Also, signals at one frequency may be transmitted by way of the diplexer while signals at the second frequency are received thereby, or vice-versa.

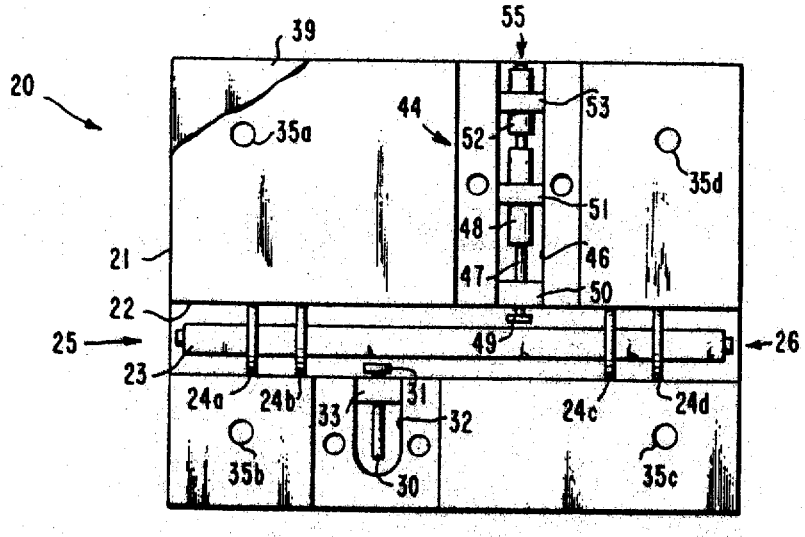

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 is confirmed.

* * * * *